United States Patent [19]

Dunlap

[11] 3,963,562

[45] June 15, 1976

[54] SLURRY DISTRIBUTOR

[75] Inventor: Harold E. Dunlap, Auburn, Mass.

[73] Assignee: Lodding Engineering Corporation, Auburn, Mass.

[22] Filed: Jan. 14, 1974

[21] Appl. No.: 432,901

[52] U.S. Cl. ..... 162/343; 162/336

[51] Int. Cl.[2] ..... D21F 1/06

[58] Field of Search ..... 162/336, 338, 343, 317, 162/212, 214, 216

[56] References Cited

UNITED STATES PATENTS

| | | | |
|---|---|---|---|
| 2,698,972 | 1/1955 | Keeler | 162/336 |
| 3,216,892 | 11/1965 | Wahlström et al. | 162/343 |
| 3,328,236 | 6/1967 | Burgess, Jr. et al. | 162/343 X |
| 3,400,044 | 9/1968 | Justus | 162/343 |
| 3,514,372 | 5/1970 | Boyce et al. | 162/216 |
| 3,628,589 | 12/1971 | Means | 162/336 |
| 3,652,391 | 3/1972 | Spengos et al. | 162/343 |
| 3,846,229 | 11/1974 | Kallmes | 162/216 |
| 3,846,230 | 11/1974 | Wahren et al. | 162/336 X |

FOREIGN PATENTS OR APPLICATIONS

| | | | |
|---|---|---|---|
| 285,424 | 1931 | Italy | 162/336 |

*Primary Examiner*—S. Leon Bashore
*Assistant Examiner*—Richard V. Fisher
*Attorney, Agent, or Firm*—Alfred H. Rosen; Frank A. Steinhilper

[57] ABSTRACT

A headbox of the pressure nozzle type has a slurry distributor providing a plurality of pairs of separated slurry passages arrayed in the cross-machine direction. The passages of each pair open at their input ends to a manifold located at one side of the distributor. Within the distributor each passage turns at a sharp angle and all the passages are aligned in the machine direction at their output ends. A nozzle structure of a turbulence-generating type is shown coupled to the distributor.

7 Claims, 3 Drawing Figures

SLURRY DISTRIBUTOR

BACKGROUND OF THE INVENTION

This invention relates to apparatus for delivering a liquid slurry to a web-forming machine, as in paper making, and more particularly to a slurry distributor suitable for use in headboxes, especially those of the pressure nozzle type.

Slurry or stock distributors are known, which cooperate with a tapered manifold to feed stock through a perforated wall to a slice chamber in paper making. Examples will be found in U.S. Pat. Nos. 3,628,589; 3,328,236; and 3,661,704.

GENERAL DESCRIPTION OF THE INVENTION

The distributor of the present invention provides a plurality of groups of separated slurry passages in a flat block-type structure that can be elongated in the cross-machine direction (CMD) the groups being distributed in the cross-machine direction suitable for receiving slurry directly from a tapered manifold. The slurry-receiving (or input) ends of the passages are oriented in a first direction which is perpendicular to both the cross-machine direction and the machine direction (MD), which facilitates their distribution in a broad wall of the distributor, which wall may form one wall of the manifold. Each passage executes a change in direction within the distributor, such that its delivery end is oriented in the machine direction. In each group, the delivery ends are arrayed side-by-side transverse to both the machine direction and the cross-machine direction. In this posture, the slurry passages can be close together at their delivery ends, for direct coupling to a large variety of down-stream slurry handling mechanisms in a compact structure. The delivery ends of the slurry passages can be coupled (for example) directly to the turbulence-inducing flow system that is described and claimed in the copending application Ser. No. 221,555 of Otto Julius Kallmes filed Jan. 28, 1972, now U.S. Pat. No. 3,846,229, which is assigned to the Assignee of the present invention. Such an arrangement is described and illustrated herein as an exemplary embodiment of the invention.

DETAILED DESCRIPTION OF THE DRAWINGS

Figure 1:
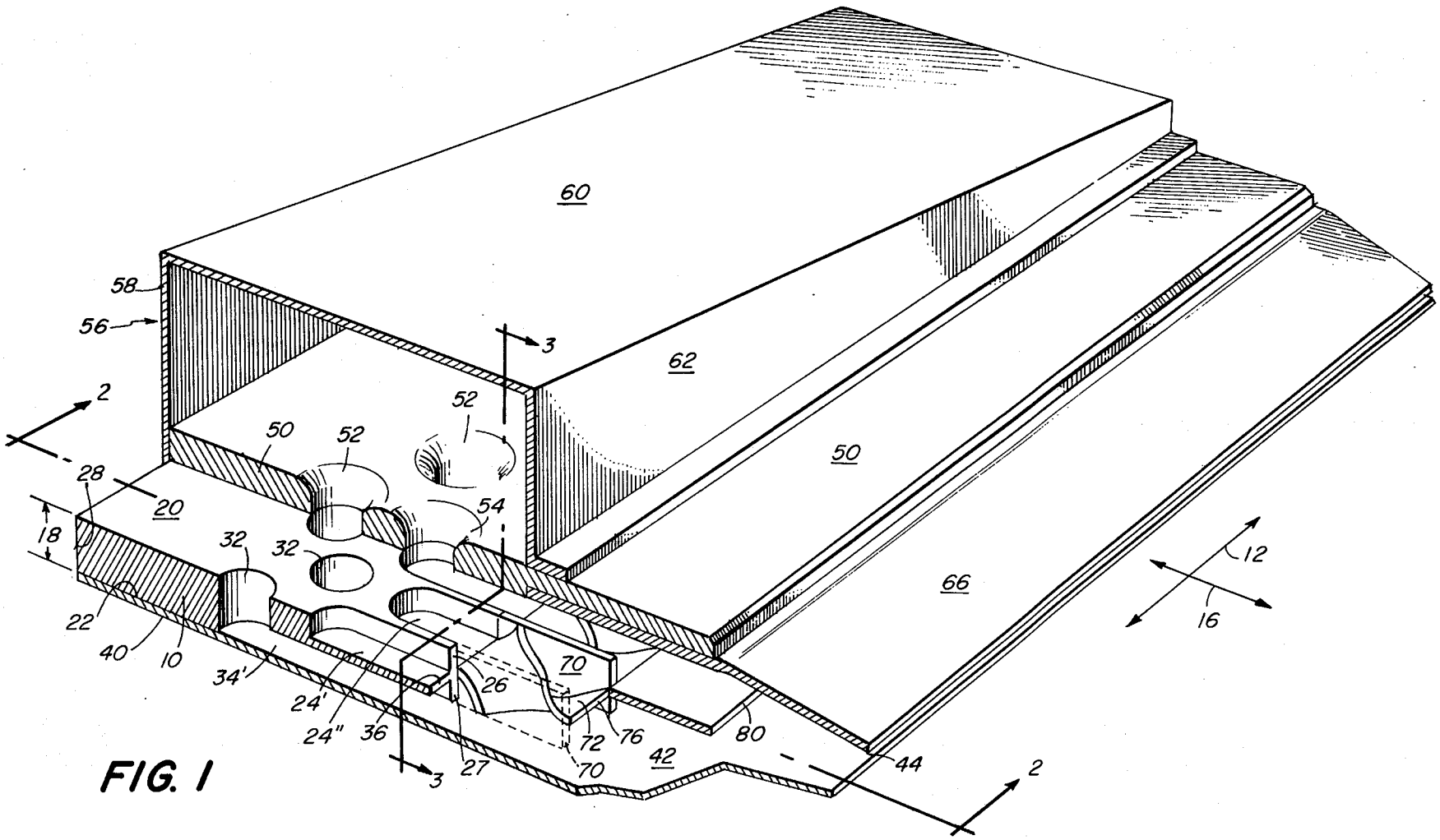
FIG. 1 is an isometric partial view of a headbox of the pressure nozzle type.
Figure 2:
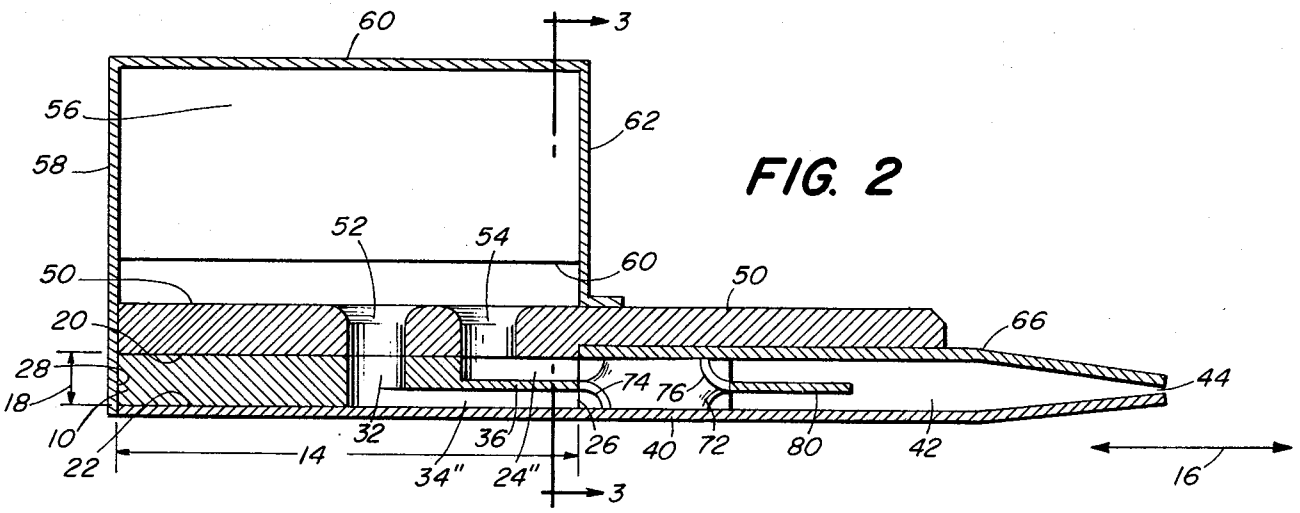
FIG. 2 is a cross-section on line 2—2 of FIG. 1.

The headbox illustrated in the drawings comprises a distributor plate 10 which is elongated in the CMD, illustrated by a double headed arrow 12, and has a rectangular cross section, of which the longer dimension 14 extends in the MD, represented by a double arrow 16. The shorter dimension 18 of the distributor plate cross-section extends perpendicular to both the CMD and the MD. The plate thus has a pair of, respectively, upper and lower opposite broad flat walls 20 and 22 which are parallel to both the CMD 12 and the MD 16.

A first series of rectangular U-shaped grooves 24 opening through the upper broad wall 20, is cut into the plate from the down-stream narrow wall 26 back toward the up-stream narrow wall 28. These grooves 24 are elongated parallel to the MD 16, and they are arrayed side-by-side in the CMD 12. The relative lengths of the grooves 24 of the first series are alternately different — alternate ones 24' being longer than intervening ones 24''. A second series of grooves 34, similar to the first grooves 24 but longer, is cut into the plate opening into the lower broad wall 22. Again, the relative lengths of the grooves of the second series are alternately different — alternate ones 34' being longer than intervening ones 34''. Each of the grooves 24, 34 has a generally circular inner end. A hole 32 is cut through the plate from the upper broad wall 20 into the end of each longer groove 34 of the second series. The hols 32 for the alternate and intervening grooves of the second series are distributed in a zig-zag array in the CMD. The grooves are arrayed in pairs, one groove 24 of the first series above one longer groove 34 of the second series, sharing a common wall 36. Alternate grooves 24' of the first series are paired with alternate grooves 34' of the second series, and the relatively shorter intervening grooves 24'' of the second series are paired with the relative-shorter intervening grooves 34'' of the second series. The direction of the array of the members of each pair of grooves is perpendicular to both the CMD 12 and MD 16. The grooves in each series are distributed across the plate 10 in the CMD 12.

A bottom plate 40 covers the lower broad wall 22 of the plate 10 and forms a fourth wall for each of the longer grooves 34 in the second series. The bottom plate 40 extends forward in the down-stream direction from the plate 10, to form the lower boundary of a slice chamber 42, and eventually one lip of a slice 44. The illustration of a slice is schematic only. The invention is not directed to features of a slice, so no need exists to illustrate details of a practical slice mechanism.

A top plate 50 covers the upper broad wall 20 of the distributor plate 10 to form a fourth wall for each of the shorter grooves 24 in the first series, and extends forward in the down-stream direction toward but terminating short of the slice 44. The top plate is fitted with feed holes 52 and 54 arranged in pairs that are one in front of the other in the MD 16, the pairs being zig-zag arrayed side-by-side in the CMD 12 to register with the inner ends of the alternate and intervening members of each series of grooves 24, 34. The feed hole 52 in each pair which is the furthest up-stream from the slice 44 is in register with a hole 32 in the distributor plate 10 for one of the grooves 34 of the second series. The second feed hole 54 of that pair is in register with the up-stream end of the shorter groove 24 of the first series that is paired with that groove 34. The feed holes 52 and 54 are rounded at their input ends, in the upper surface of the cover plate 50, to facilitate the entry of a liquid slurry, such as a paper feed stock.

Figure 3:
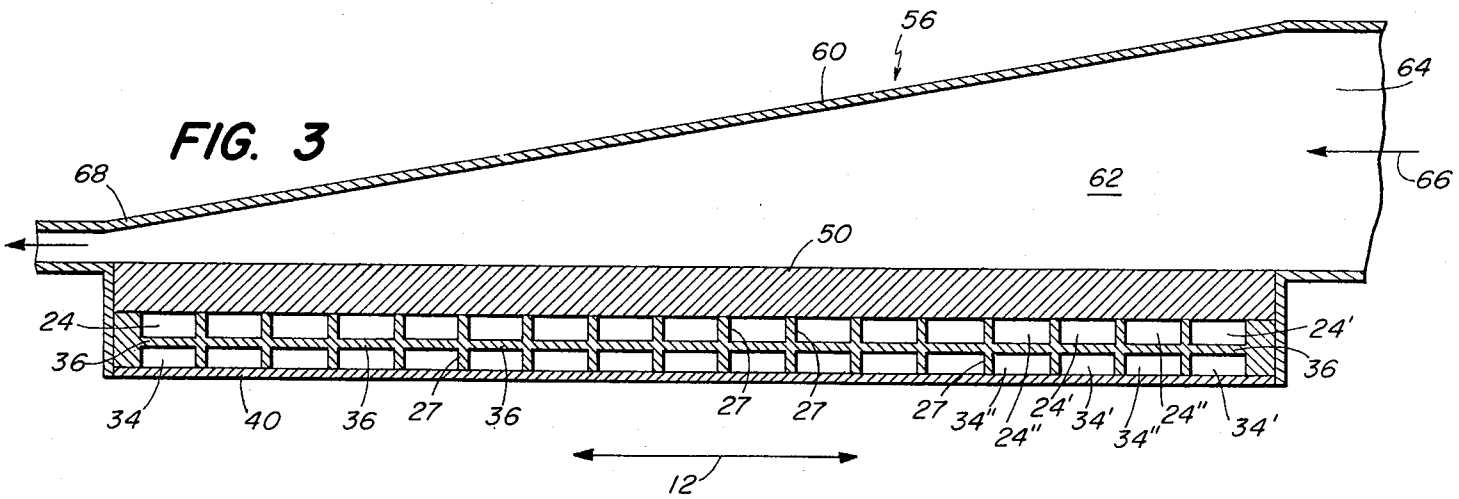
FIG. 3 is a cross-section on line 3—3 of FIG. 2.

A tapered manifold 56 comprising a back wall 58, top wall 60, front wall 62 and the top plate 50 of the distributor is provided to feed stock to the distributor. As is illustrated in FIG. 3, slurry enters the manifold at the larger end 64 in the direction of the arrow 66, and overflow exits at the smaller end 68. The slurry is distributed through the pairs of feed holes 52, 54 to the distributor passages formed by the pairs of grooves 24, 34 and the covers 50, 40. The slurry makes one sharp turn in each passage 34, 24 and exits from the passages in the MD 16.

An upper slice plate 66 is fitted into a recess in the top cover 50 and extends forward to form one wall of the slice chamber 42, and terminates in one lip of the slice 44. The slice chamber 42 extends in the CMD 12.

It is contemplated that the distributor of this invention may be used to supply a slice chamber of any type or kind. In the illustrated example the slice chamber 42 incorporates turbulence generating structures of a kind that is described and claimed in the above-identified co-pending application Ser. No. 221,555, now U.S. Pat. No. 3,846,229. Extending in the down-stream direction from the down-stream narrow wall 26 of the distributor, in register with the partition 27 between each pair of grooves 24, 34 and the adjacent pair, is a vertical wall 70 which also extends perpendicular to both the CMD 12 and the MD 16 between the lower and upper slice chamber walls 40, 66, respectively. Adjacent pairs of vertical walls 70 form with the slice chamber walls a series of side-by-side passages or conduits each of which extends in the MD 16, and each passage having a rectangular cross section transverse to the MD 16. Each of these passages is thus an extension in the down-stream direction of the passages through the pair of grooves 24, 34 to which it is mated. Each of these passages is fitted with a vane 72 which extends entirely across the passage and divides the passage into two passages of substantially equal cross section. Each vane 72 has an up-stream edge 74 which mates in register with the common wall 36 between the two grooves 24, 34 of the mated pair. Each vane is warped around a longitudinal dimension of the passage in which it is fitted so that its orientation across the passage progressively changes from the up-stream end to the down-stream end. Conveniently, the orientation of each vane 72 progresses through 180°, and its down-stream edge 76, like its up-stream edge 74, is parallel to the slice 44. Thus the distributor passages of each pair of grooves 24, 34 supply a rectangular passage which is divided by the included vane 72 into two passages, each in register with one of the distributor passages. Slurry flowing out of the distributor passages is thereby given a spinning motion having components transverse to both the CMD and to the MD, around the longitudinal axis of its direction of propagation, i.e., around an axis that is parallel to the MD.

The spinning-motion component is damped by a rectifier vane 80 which is fixed within the slice chamber 42 and extends in the CMD parallel to the slice 44. The rectifier vane mates at its up-stream edge with the down-stream edges 76 of the vanes 72. As is explained in the above-mentioned copending application, the turbulence inducing structure provides intense fine-scale turbulence with a minimum of large scale currents. While the distributor of the present invention is especially suited for feeding slurry to such turbulence generating mechanisms, it is not limited to use with those mechanisms.

I claim:

1. A distributor of liquid slurry for a web-forming machine, said distributor comprising means defining a plurality of separated slurry passages, each passage having a slurry-receiving end and a slurry-delivery end, and being continuous between said ends, said passages being distributed in the cross-machine direction, all of said passages having slurry-receiving ends oriented in a first direction for receiving slurry from a common source, each passage making a substantially rectangular direction change between its slurry-receiving end and its slurry-delivery end so as to orient said passage in a second direction prior to its slurry-delivery end, a slurry flow system including turbulence-inducing means and means coupling all of the slurry-delivery ends of the passages to said turbulence-inducing means, and slice means for receiving slurry from said turbulence-inducing means.

2. A distributor of liquid slurry for a web-forming machine, said distributor comprising means defining a plurality of pairs of separated slurry passages, each passage having a slurry-receiving end and a slurry-delivery end, and being continuous between said ends, said pairs being distributed in the cross-machine direction, all of said passages having slurry-receiving ends oriented in a first direction which is substantially perpendicular to both the machine direction and the cross-machine direction with the slurry-receiving ends of each pair side-by-side in the machine direction, for receiving slurry from a common source, each passage making a substantially rectangular direction change between its slurry-receiving end and its slurry-delivery end to a second direction that is substantially parallel to the machine direction and transverse to the cross-machine direction, the slurry-delivery ends of the passages in each pair being arrayed side-by-side transverse to both the machine direction and the cross-machine direction, the slurry-delivery ends of the passages being rectangular in cross-section, and the slurry-delivery ends of the passages in each pair having sides which share a common wall and the members of each pair sharing a common wall with the slurry-delivery ends of the passages of each adjacent pair.

3. A distributor according to claim 2 including a flat plate elongated in the cross-machine direction and having a rectangular cross-section with a long dimension that extends in the machine direction and a short dimension that is perpendicular to both the machine and the cross-machine directions, said plate having for each of said pairs rectangular U-shaped grooves oriented bottom-to-bottom and separated at their confronting bottoms by a septum constituting a common wall and opening at their tops into the respective opposite wide walls of said plate, said grooves extending from the down-stream narrow wall of said plate part way across said plate in the machine direction, a first of said grooves in each pair being longer than the second, and a hole through said plate extending from the side wall of said plate that is opposite said longer groove into a portion of said longer groove that extends across said plate beyond the shorter groove.

4. A distributor according to claim 3 including a first cover plate over the wide wall of said plate into which said longer grooves open, and a second cover plate over the wide wall of said plate into which said shorter grooves open, said second cover plate having a first aperture in register with said hole of each group and a second aperture in register with the inner end of said shorter groove of each group, said apertures constituting said slurry-receiving ends of said passages.

5. A distributor according to claim 4 including a manifold having said second cover plate as one wall thereof, for supplying slurry to said passages.

6. A distributor according to claim 4 including slice means extending from said cover plates in the machine direction.

7. A distributor according to claim 2 in which alternate ones of said pairs of passages are relatively longer than intervening ones of said pairs, so that said slurry-receiving ends are distributed in a zig-zag pattern in the cross-machine direction.

* * * * *